United States Patent [19]

Partilla et al.

[11] Patent Number: 4,924,265

[45] Date of Patent: May 8, 1990

[54] AUTOMATIC INSERT FEED CONTROL

[75] Inventors: Stephen R. Partilla, Webster; Mark F. Mungenast, Penfield, both of N.Y.

[73] Assignee: Xerox Corporation, Stamford, Conn.

[21] Appl. No.: 168,042

[22] Filed: Mar. 14, 1988

[51] Int. Cl.[5] ..... G03G 21/00

[52] U.S. Cl. ..... 355/204; 355/308; 355/325

[58] Field of Search ..... 355/6, 14 D, 14 E, 14 SH, 355/14 R, 204, 308, 325

[56] References Cited

U.S. PATENT DOCUMENTS

| | | | |
|---|---|---|---|
| 3,851,236 | 11/1974 | Dennhardt et al. | 355/14 E X |
| 4,190,246 | 2/1980 | Sasuga | 271/145 |
| 4,248,528 | 2/1981 | Sahay | 355/14 R |
| 4,372,674 | 2/1983 | Yukawa et al. | 355/14 D |
| 4,568,181 | 2/1986 | Nishiyama | 355/75 |

FOREIGN PATENT DOCUMENTS 58-224359 12/1983 Japan .

*Primary Examiner*—A. T. Grimley
*Assistant Examiner*—E. J. Pipala
*Attorney, Agent, or Firm*—Ronald F. Chapuran

[57] ABSTRACT

The present invention is a control for automatically providing inserts into a copy set corresponding to inserts in the document set including an optical sensor responding to the reflectance of an original document that allows logic circuitry to determine if the original is white or non-white paper. If non-white, the logic of the control switches to a predetermined paper feed tray or paper bypass where the operator has placed an insert copy paper or cover stock, thus, the appropriate paper tray is selected to place inserts in the correct locations within the copy sheet.

2 Claims, 2 Drawing Sheets

AUTOMATIC INSERT FEED CONTROL

This invention relates to electrophotographic machines and, in particular, to the method and apparatus for automatically feeding inserts into a copy set.

BACKGROUND OF THE INVENTION

The multifunction reproduction machine of today usually allows the reproduction of a set of documents as an integral finished set by the use of pre-collation or post-collation techniques. Often, however, it is desirable, to reproduce a set of documents that includes cover sheets, dividers or other inserts. These inserts, preferably, are often a different color, composition, or format than the standard copy sheet. Even if it is possible to preload these inserts into the copy sheet tray, and the copy sheet conveyer apparatus can accommodate the inserts, preloading requires the operator to manually position the inserts in the proper sequence in the copy set. This is time consuming as well as open for error.

It is known in the prior art to be able to sense the background color of a document or the size of a document or copy sheet and respond in a predetermined manner. It is also known to be able to feed copy sheets from multiple copy sheet feed trays. For example, U.S. Pat. No. 4,372,674 to Yukawa et al discloses a copying machine with a means to detect the background color and density of an original using a wavelength detector and a reflectance intensity detector. An electronic circuit is used to generate a bias voltage for a developing apparatus based on the measured density and color of the original's background.

U.S. Pat. No. 4,568,181 to Nishiyama teaches a method of original size detection in an electrophotographic copying machine. A light receiving element and a control circuit are used to automatically select a copy document of the correct size. Interruption of light to the light receiving element is a means to calculate original document size.

Japanese Pat. No. 58-224359 to Nakajiyou, assigned to Fuji Xerox K. K., discloses an electrophotographic copying machine provided with an auxiliary paper feeder to enable the use of different kinds and sizes of paper. The auxiliary feeder is of a multi-stage type, or the like. U.S. Pat. No. 4,190,246 to Sasuga, assigned to Rank Xerox Ltd., discloses a paper feeding system with a selector circuit that compares stored paper sizes with operator-selected dimensions to assure feeding the proper size paper.

It is also known to provide special programming for the copying of selected documents selected by a control system for a recirculating document handler (RDH) actuated automatically by special document slip sheets fed with, but ahead of, regular documents. These slip sheets are specially designed to interact with a pair of existing document jam sensors in the RDH to actuate the special programming. These document slip sheets may be of ordinary paper, but are notched at at least one location corresponding during feeding to at least one of the plural document jam or document width sensor locations spaced transversely of the document path of the RDH to provide a special logic control signal from said plural jam sensors actuation/non-actuation combination different from a normal jam signal. This control signal can stop the RDH document recirculation at the slip sheet point for special operator job input for the subsequent document, or all subsequent documents, or actuate a preset special copying mode of various kinds. The system does not require marked sheets as disclosed in U.S. Pat. No. 4,248,528.

It would be desirable, however, to be able to load a set of documents including suitable colored inserts into a document handler and load a set of suitable inserts into an auxiliary tray, and have the inserts in the auxiliary tray automatically inserted into the copy set in positions corresponding to the document set inserts.

It is an object, therefore, of the present invention to provide a new and improved technique to automatically provide inserts into a copy set corresponding to the inserts in the document set. Further objects of the present invention will become apparent as the following description proceeds, and the features characterizing the invention will be pointed out in the claims annexed to and forming a part of this specification.

SUMARY OF THE INVENTION

Briefly, the present invention is a control for automatically providing inserts into a copy set corresponding to inserts in the document set including an optical sensor responding to the reflectance of an original document that allows logic circuitry to determine if the original is white or non-white paper. If non-white, the logic of the control switches to a predetermined paper feed tray or paper bypass where the operator has placed an insert copy paper or cover stock. Thus, the appropriate paper tray is selected to place inserts in the correct locations within the copy set.

Other aspects of the present invention will become apparent as the following description proceeds and upon reference to the drawings in which like numerals refer to like parts and wherein.

DESCRIPTION OF THE PREFERRED EMBODIMENT

Figure 1:
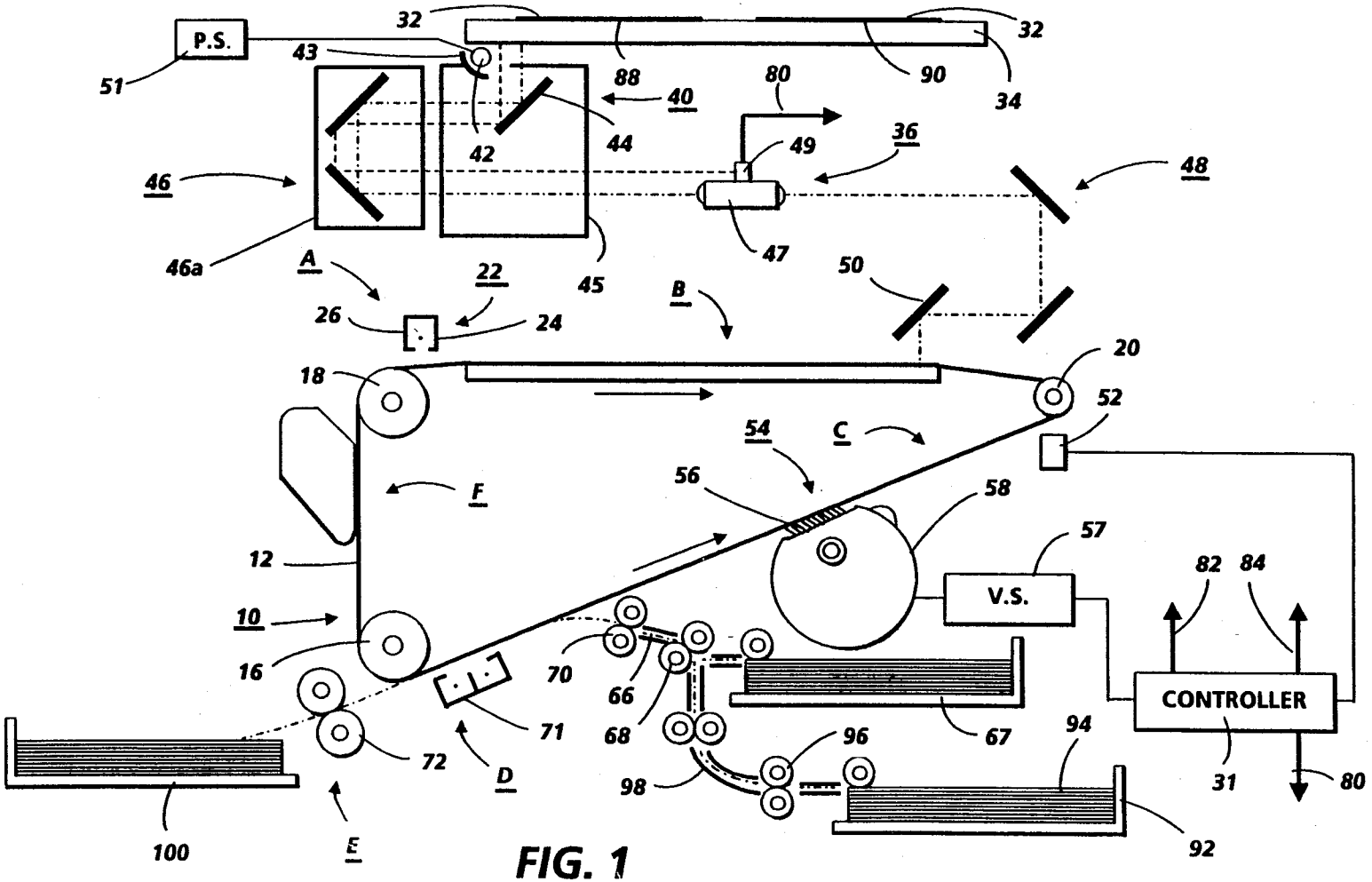
FIG. 1 is a side schematic view of an electrophotographic printing machine incorporating the features of the present invention.

FIG. 1 schematically depicts the various components of an illustrative electrophotographic printing machine incorporating the control system of the present invention therein. It will become apparent from the following discussion that this control system is equally well suited for use in a wide variety of electrophotographic printing machines and is not necessarily limited in its applications to the particular embodiment shown herein. Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine sees a photoreceptor belt 10 having a photoconductive surface 12 formed on a conductive substrate. Belt 10 moves in the indicated direction, advancing sequentially through the various xerographic process stations. The belt is entrained about drive roller 16 and tension rollers 18, and 20. Roller 16 is driven by conventional motor means (not shown).

With continued reference to FIG. 1, a portion of belt 10 passes through charging station A where a corona generating device, indicated generally by the reference numeral 22, charges photoconductive surface 12 to a relatively high, substantially uniform, negative potential. Device 22 comprises a charging electrode 24 and a conductive shield 26. A high voltage supply controlled by a portion of controller 31, is connected to shield 26.

As the belt continues to advance, the charged portion of surface 12 moves into exposure station B. An original document 32 is positioned, either manually or by a document feeder mechanism (not shown) on the surface of a transparent platen 34. Optics assembly 36 contains the optical components which incrementally scan-illuminate the document and project a reflected image onto surface 12 of belt 10. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath the platen. Lamp 42 illuminates an incremental line portion of documents 32. The reflected image is reflected by scan mirror 44 to coroner mirror assembly 46 on a second scan carriage 46A moving at 1/2 the rate of mirror 44.

The document image is projected through lens 47 and reflected by a second coroner mirror 48 and belt mirror 50, both moving at a predetermined relationship so as to proceed the projected image while maintaining the required rear conjugate onto surface 12 to form thereon an electrostatic latent image corresponding to the informational area contained within original document 32. In accordance with the present invention, an optical sensor 49 connected to controller 31 is disposed near lens 47 in the optical path of the image projected from original document 32. Adjustable illumination power supply 51, controlled by a portion of controller 31, supplies power to lamp 42.

The belt then advances past a DC electrometer 52 positioned adjacent to the photoconductive surface 12 between the exposure station B and development station C to generate a signal proportional to the dark development potential on the photoconductive surface. The dark development potential is the charge maintained on the photoconductor after charging and exposure, reflected from an opaque target or object. Preferably, the electrometer 52 is a nulling type device having a (not shown) probe and head assembly and the potential of the head and probe assembly is raised to the potential of the surface being measure. The generated signal is conveyed to controller 31 through suitable conversion circuitry. The controller 31 is also electrically connected to a (not shown) high voltage power supply through suitable logic interface to control the bias voltage on the conductive shield 26 of the charging corotron in response to the generated signal from the electrometer 52 to adjust the dark development potential.

At development station C, a magnetic brush development system, indicated generally by the reference numeral 54, advances an insulating development material into contact with the electrostatic latent image. Preferably, magnetic brush development system 54 includes a developer roller 56 within a housing 58. Roller 56 transports a brush of developer material and deforms belt 10 in an arc with the belt conforming, at least partially, to the configuration of the developer material. The electrostatic latent image attracts the toner particles from the carrier granules forming a toner powder image on photoconductive surface 12. As successive latent images are developed, toner particles are depleted from the developer material. A toner particle dispenser, indicated generally by the reference numeral 60 provides additional toner particles to housing 58 for subsequent use by developer roller 56. Toner dispenser 60 includes a container for storing a supply of toner particles therein and means (not shown) for introducing the particles into developer housing 58.

An output copy sheet 66 taken from a supply tray 67, is moved into contact with the toner powder image at transfer station D. The support material is conveyed to station D by a pair of feed rollers 68 and 70. Transfer station D includes a corona generating device 71 which sprays ions onto the back side of sheet 66, thereby attracting a toner powder image from surface 12 to sheet 66. After transfer, the sheet advances to fusing station E where a fusing roller assembly 72 affixes the transferred powder image. After fusing, sheet 66 advances to an output tray (not shown) for subsequent removal by the operator. After the sheet of support material is separated from belt 10, the residual toner particles are removed at cleaning station F.

Figure 2:
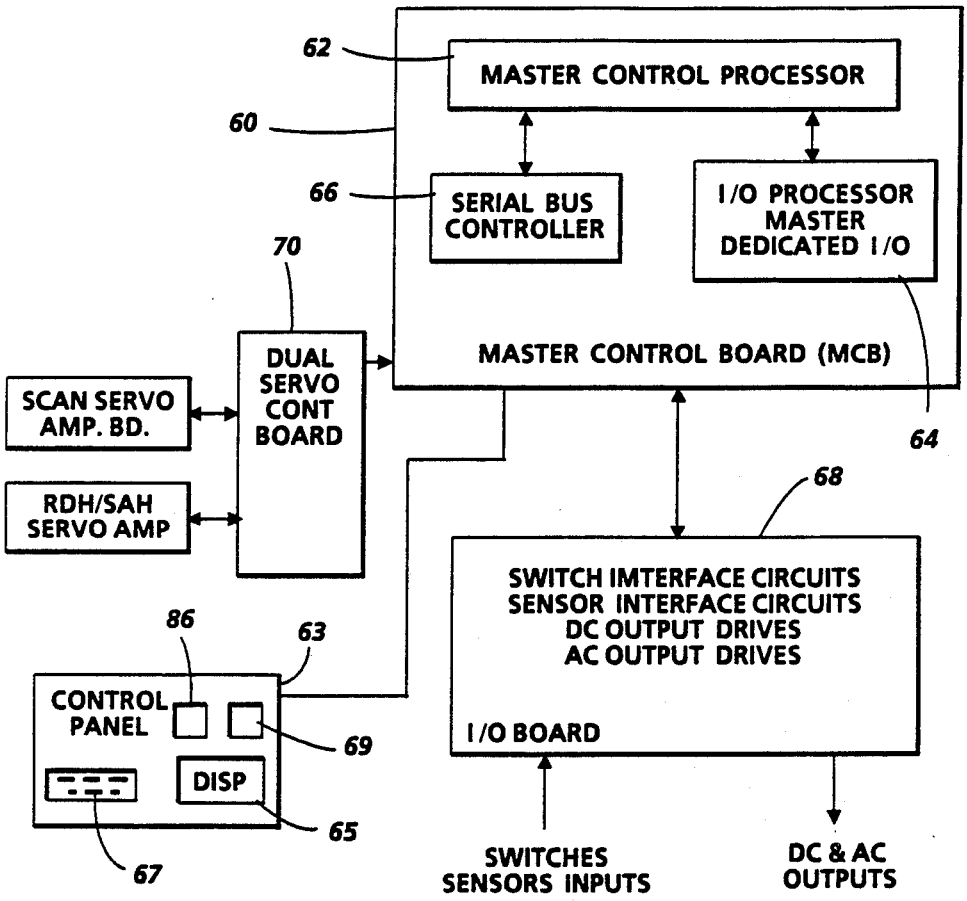
FIG. 2 is a schematic block diagram of the control circuitry for implementing the present invention.

With reference to FIG. 2, there is illustrated the general control of the xerographic printing machine. In particular, the controller 31 includes a master control board 60, including an Intel 8085 master control processor 62, an Intel 8085 input/output processor 64 and a serial bus controller 66 connected to an input/output board 68 including various switch and sensor interface circuits and DC and AC output drivers. In a preferred embodiment the master control processor includes 80K ROM, 8K RAM and 2K MBM memories and suitable timing and reset circuitry. The input/output processor includes 8K ROM, 2K RAM, AD and DA converters and an 8253 timer and 8259 interrupt controller, as well as suitable input and output ports. The master control board 60 is also connected to a dual servo control board 70 over a serial bus for handling scan and document handling servos. Also, connected to the master control board 60 is a control panel 63 with suitable display 65 and key board 67 for entering program data and displaying control and diagnostic information.

Figure 3:
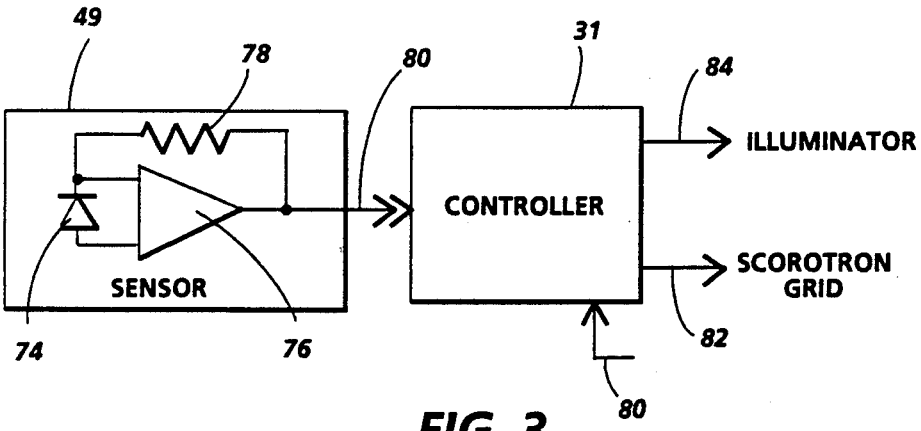
FIG. 3 illustrates the sensor and control response in accordance with the present invention.

With reference to FIG. 3, there is illustrated the sensor 49 in more detail. Preferably, the optical sensor 49 includes a blue sensitive photodiode 74, amplifier 76, and resistor 78 supported on a (not shown) printed circuit board. Preferably, the optical sensor 49 is mounted to the frame of the machine generally shown in FIG. 1 at a location near the lens 47 in the optical path of the light rays reflected from a document on platen 34 projected to the photoreceptor belt 10. The signal 80 from the optical sensor 49 is suitably conveyed to the controller 31, in turn, providing illuminator signal 84 to the power supply 51 of lamp 43.

Since the optical sensor 49 is positioned in the optical path, in effect, the sensor views each segment or portion of a document on the platen 34 as it is scanned by the illumination scan assembly 40. This allows the sensor to view the entire length of the platen 34 and any documents supported on the platen. That is, by a suitable timing signal from the controller 31, the sensor 49 will provide the signal 80 to the controller at any preselected or designated location along the platen and thus along a document to be scanned.

In operation the background correction or non-white background switch 68 located on control panel 63 electrically connected to controller 31 is activated upon the determination that a non-white background document is to be copied. In response, the master control processor 62 provides an output signal 84 via the input/output board 68 to power supply 51 to adjust the illumination level of lamp 43 to further eliminate the background that will appear on the copy sheet.

In accordance with the invention, a dedicated insert switch 86 on the control panel 63 is activated to provide a signal to the master control board in particularly the master control processor 62. A dedicated or auxiliary tray 92 is preloaded with special insert sheets 94, the insert sheets 94 being driven by drive rolls 96 and conveyor 98 to registration rolls 70 or alternatively driven directly to a suitable output tray to be combined with a copy set corresponding to an insert contained in the document set to be copied.

In operation, the sensor 49 determines the reflectance or density of the original placed face down the platen 34. As described above upon sensing a non-white background, preferably representing a divider or insert in the document set to be also provided in the copy sheet set, the sensor provides the appropriate signal 80 to the master control processor 62. If a non-white or insert document is sensed, the master control processor 62 provides a signal to the auxiliary tray 92 or alternatively to a paper bypass area of the machine where an operator has placed an insert copy sheet or cover stock. The master control processor 62 accordingly, therefore, activates the auxiliary tray drive 96 to provide an insert 94 through the conveyor 98 into the copy sheet output tray to place an insert in the appropriate location in the copy sheet stack.

In a preferred embodiment, the cover sheet or insert is an alternate paper that may or may not be imaged. In a preferred embodiment, the special inserts from the tray 92 are conveyed to the registration station to the output tray 100. However, for inserts or dividers, the normal imaging and development process is inhibited. Thus, it is possible to provide inserts or dividers in normal simplex-to-simplex or duplex-to-duplex modes. In the case of a simplex-to-duplex operation, a special instruction may be required depending upon desired output.

The automatic feeding of insets and dividers from a special tray eliminates the need for an operator to determine the position of inserts within an original set and to manually provide the inserts or to key these positions into memory in the copier control. It should be understood that it is within the scope of the invention to bypass the registration station and feed the inserts directly from the tray 92 to the output tray 100 for those inserts in which no printing or imaging is required.

While there has been illustrated and described what is at present considered to be a preferred embodiment of the present invention, it will be appreciated that numerous changes and modifications are likely to occur to those skilled in the art and it is intended in the appended claims to cover all those changes and modifications that fall within the spirit and scope of the present invention.

What is claimed is:

1. In a copying machine with a control, transfer station and output tray for copying a set of originals: having a background area onto copy sheets, including means for projecting light on the originals and detecting means for receiving light reflected from the background portion of the originals and producing signals in accordance with the density of the light reflected from the background portion of the originals, and including a first supply station providing the copy sheets and a second supply station providing insert sheets, the detector including a photo diode and amplifier located in the light path of the rays reflected form the originals, the improvement comprising:

means responsive to a first signal from the detecting means for providing insert sheets from the second supply station in the reproduced set of originals, the control including the option to provide the insert sheets to the transfer station or directly to the output tray.

2. The copying machine of claim 1 wherein the insert sheets are cover sheets or dividers.

* * * * *